US012017884B2

(12) United States Patent
Casey

(10) Patent No.: US 12,017,884 B2
(45) Date of Patent: Jun. 25, 2024

(54) CABLE ORGANIZING DEVICE

(71) Applicant: Kevin Christian Casey, Grandview, MO (US)

(72) Inventor: Kevin Christian Casey, Grandview, MO (US)

( * ) Notice: Subject to any disclaimer, the term of this patent is extended or adjusted under 35 U.S.C. 154(b) by 0 days.

(21) Appl. No.: 17/966,431

(22) Filed: Oct. 14, 2022

(65) Prior Publication Data

US 2023/0120365 A1 Apr. 20, 2023

Related U.S. Application Data

(60) Provisional application No. 63/256,833, filed on Oct. 18, 2021.

(51) Int. Cl.
*B65H 75/02* (2006.01)
*B65H 75/28* (2006.01)

(52) U.S. Cl.
CPC ..... *B65H 75/02* (2013.01); *B65H 75/285* (2013.01)

(58) Field of Classification Search
None
See application file for complete search history.

(56) References Cited

U.S. PATENT DOCUMENTS 2,351,379 A * 6/1944 Wehringer ..... H02G 11/02 D8/356
4,249,707 A * 2/1981 Jones ..... A01K 97/06 242/613.2
4,492,350 A * 1/1985 Dgetluck ..... B65H 75/14 242/118.8
4,721,268 A * 1/1988 Lerner ..... H02G 11/02 242/129
4,778,125 A * 10/1988 Hu ..... H02G 11/02 242/402
5,819,894 A * 10/1998 Okamoto ..... H02G 11/02 191/12.4
6,024,317 A * 2/2000 Kovacik ..... B65H 75/4473 242/405.1
6,076,759 A * 6/2000 Simonson ..... B65H 75/4476 242/405
7,318,563 B2 * 1/2008 Houts ..... G08B 13/1445 70/30
2009/0102341 A1 * 4/2009 Young, IV ..... B65H 75/36 242/118
2011/0101146 A1 * 5/2011 Bordignon ..... B65H 75/06 242/405.2
2013/0075522 A1 * 3/2013 Penumatcha ..... B65H 75/14 242/614
2013/0220872 A1 * 8/2013 Stiehl ..... B65H 75/285 206/577
2017/0081146 A1 * 3/2017 Dockray ..... B65H 75/14

FOREIGN PATENT DOCUMENTS

DE 10 2014 009 486 * 12/2014
DE 20 2017 000 975 * 5/2017

* cited by examiner

*Primary Examiner* — William A. Rivera
(74) *Attorney, Agent, or Firm* — Nelson Mullins Riley & Scarborough LLP

(57) ABSTRACT

The invention is directed to an organizing device for cables comprising a spool, wherein the spool comprises: a barrel; an upper flange affixed to a first side of the barrel; and a lower flange affixed to a second side of the barrel, wherein the barrel is elliptical and wherein the upper flange and the lower flange each extend outwardly beyond the barrel.

17 Claims, 5 Drawing Sheets

CABLE ORGANIZING DEVICE

CROSS-REFERENCE TO RELATED APPLICATIONS

This application is claims benefit of provisional of U.S. Patent Application No. 63/256,833 filed on Oct. 18, 2021, entitled "CABLE ORGANIZING DEVICE", which is incorporated here in its entirety.

FIELD OF THE INVENTION

The present disclosure relates in general to accessory devices for cables and more particularly, cables for mobile phones, computing devices, or the like. In particular, the disclosed embodiments include a device for storing a connectivity cable for an electronic device.

SUMMARY

In an embodiment, the invention is directed to an organizing device for cables comprising a spool, wherein the spool comprises: a barrel; an upper flange affixed to a first side of the barrel; and a lower flange affixed to a second side of the barrel, wherein the barrel is elliptical and wherein the upper flange and the lower flange each extend outwardly beyond the barrel. In an embodiment, each of the two flanges has an outer face, a first side face, and a second side face, each of the first and second side faces extending between two elongated ends of each of the flanges. In an embodiment, the upper flange comprises a cavity located in the outer face thereof. In an embodiment, the cavity is shaped and sized to receive a first terminal end of a cable. In an embodiment, the cavity comprises a bottom surface, a top surface, and at least one sidewall, and wherein the top surface comprises a retention feature which secures the first terminal end of the cable in position. In an embodiment, a channel extends from the cavity to one of the two elongated ends of the upper flange. In an embodiment, the channel is configured to receive the cable. In an embodiment, the two elongated ends of each of the flanges are curved. In an embodiment, each of the two flanges are elliptical. In an embodiment, the barrel is curvedly affixed to the upper flange and to the lower flange. In an embodiment, the barrel is configured to receive the cable such that the cable can be wound about the barrel. In an embodiment, at least one notch is disposed in the first or second side face of the upper flange or the first or second side face of the lower flange. In an embodiment, the notches are sized to receive the cable. In an embodiment, the notches are smaller in at least one dimension than a second terminal end of the cable. In an embodiment, at least one lower cavity is disposed within the lower flange. In an embodiment, the at least one lower cavity is configured to receive the second terminal end of the cable. In an embodiment, at least one indention is positioned in the side wall of the upper flange or lower flange. In an embodiment, the indentions are centrally located within the side wall of the upper flange or lower flange, on opposite longitudinal sides of the device.

BRIEF DESCRIPTION OF THE SEVERAL VIEWS OF THE DRAWINGS

Figure 1:
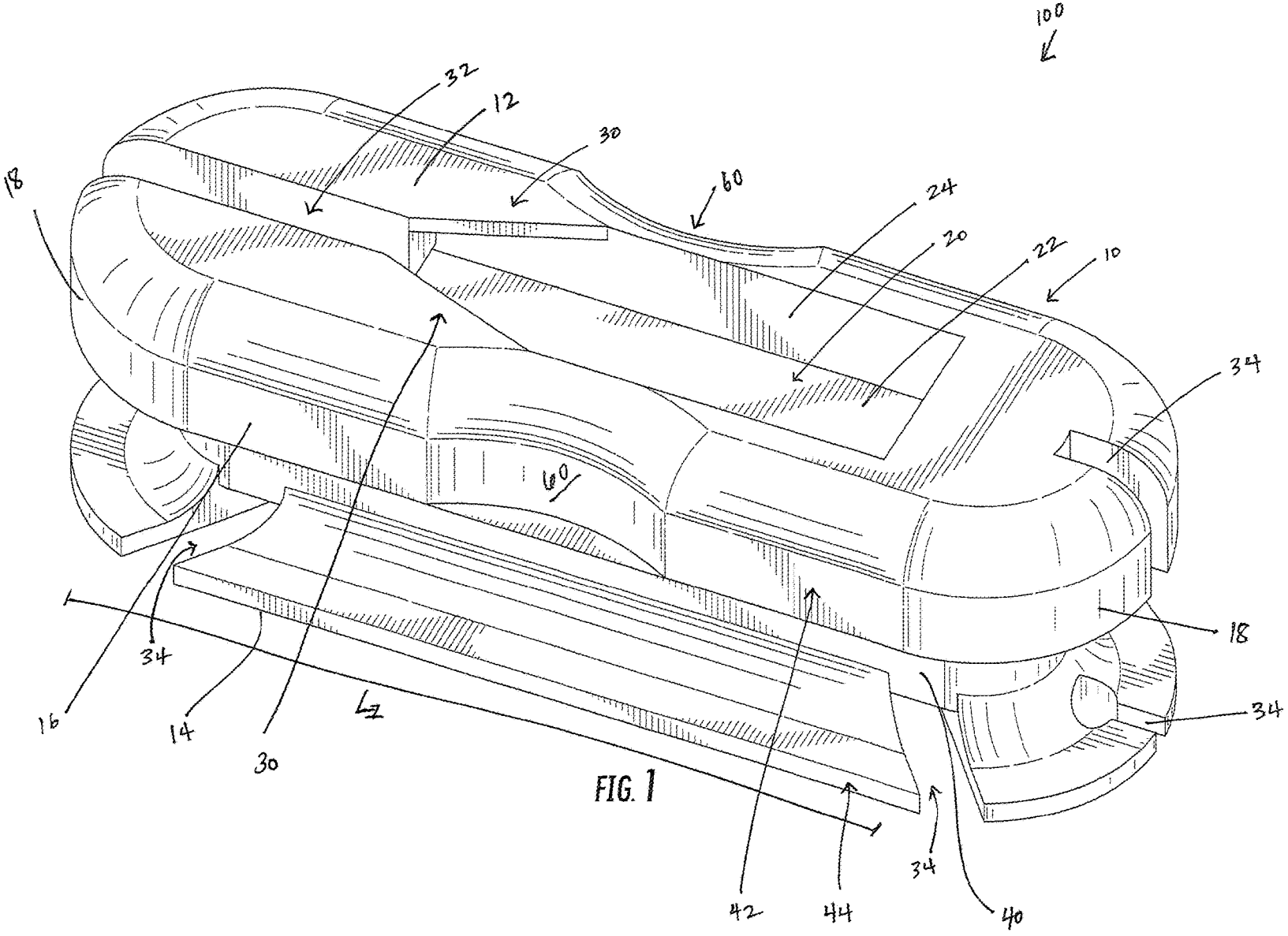
Figure 2:
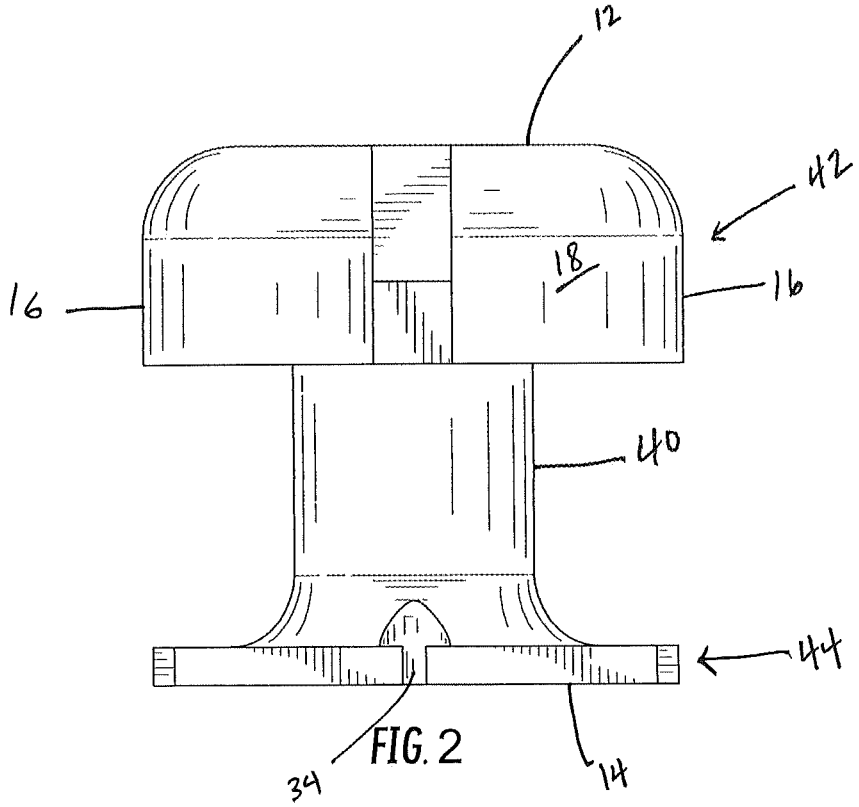
Figure 3:
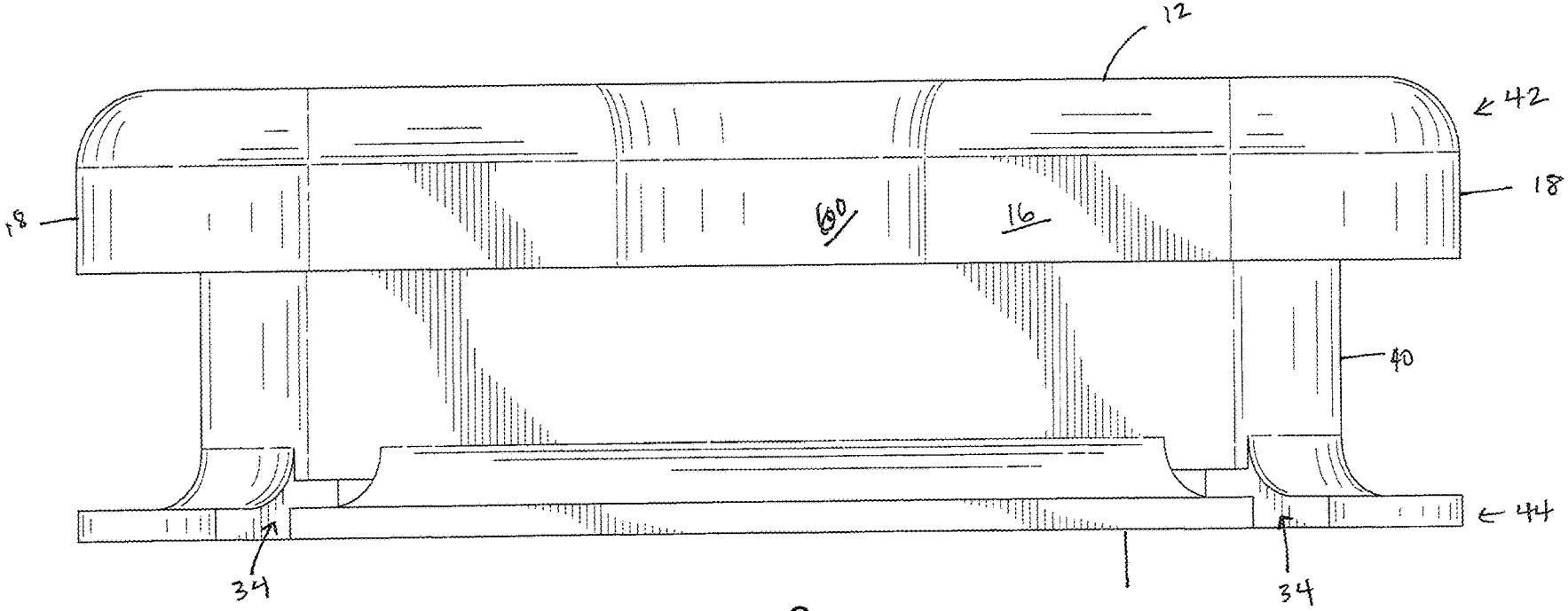
Figure 4:
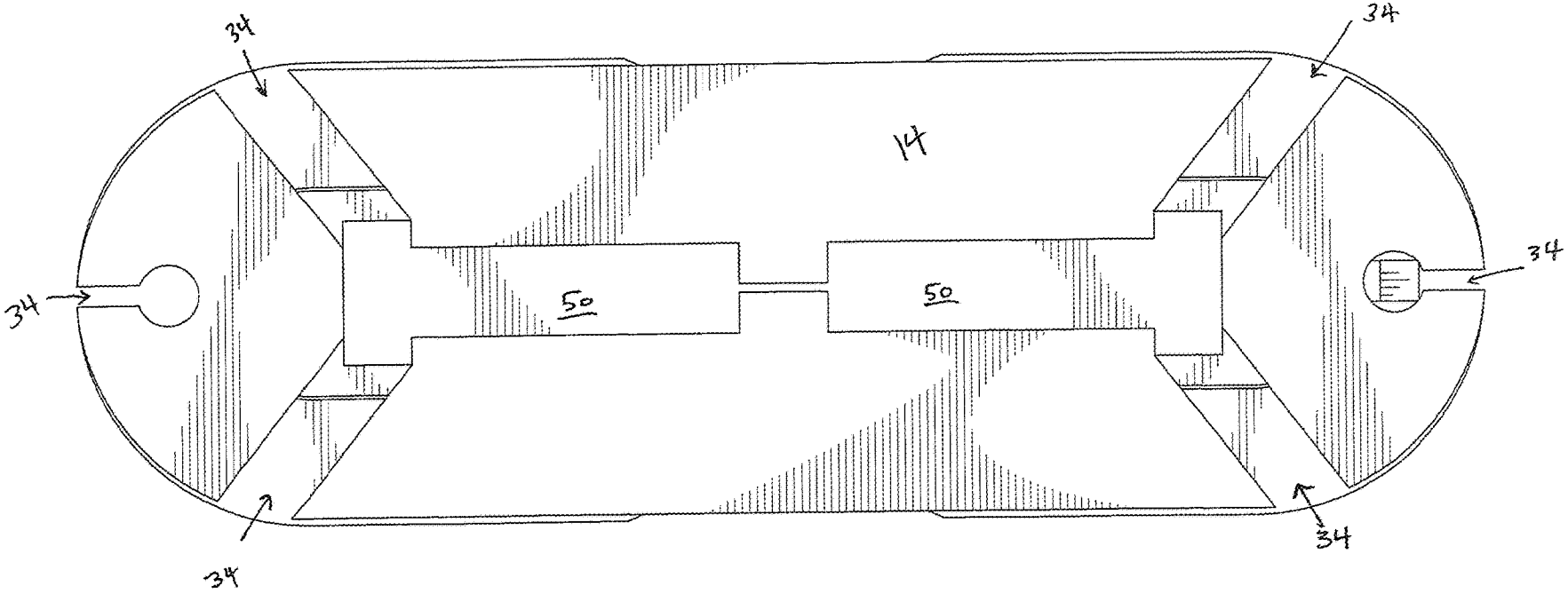
Figure 5A:
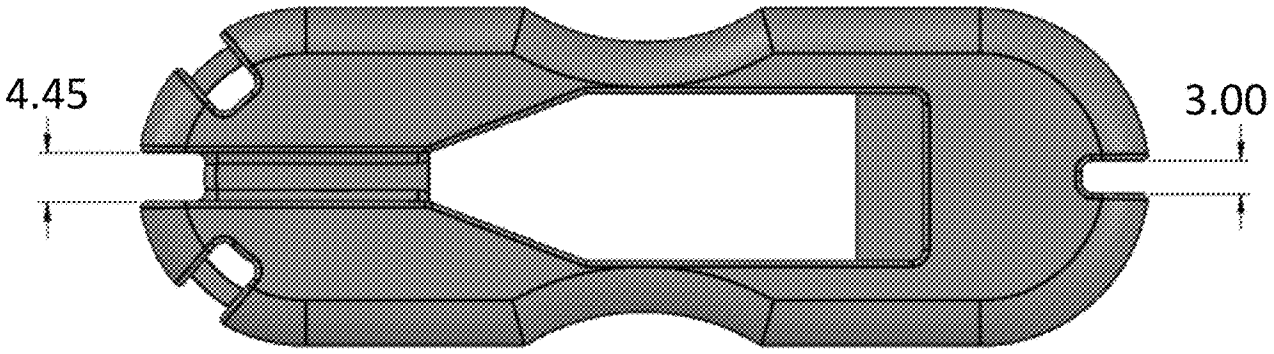
Figure 5B:
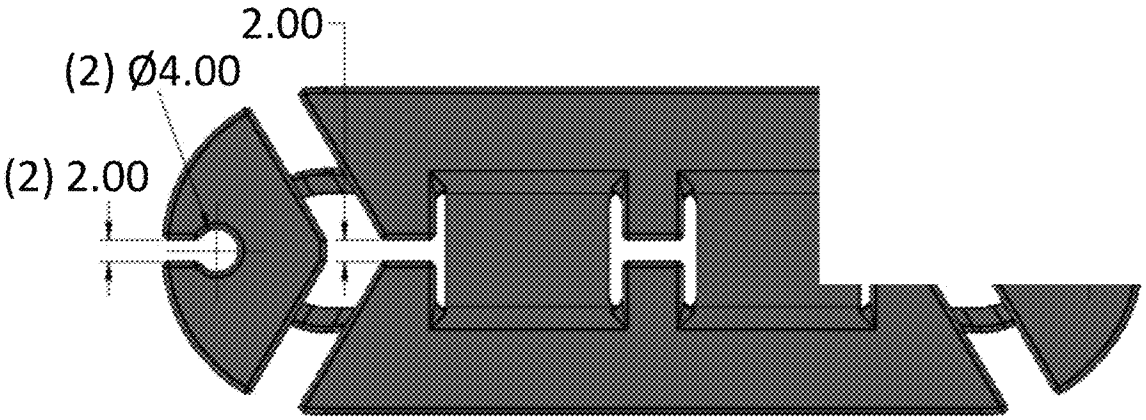

Having thus described the disclosure in general terms, reference will now be made to the accompanying drawings, which are not necessarily drawn to scale, and wherein:

FIG. 1 illustrates an isometric view of a device according to an embodiment of the invention;

FIG. 2 illustrates an end view of a device according to an embodiment of the invention;

FIG. 3 illustrates a side view of a device according to an embodiment of the invention;

FIG. 4 illustrates a bottom view of a device according to an embodiment of the invention; and FIG. 5A illustrates a top view and FIG. 5B illustrates a bottom view of a device according to an embodiment of the invention.

DETAILED DESCRIPTION

The present invention now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Disclosed embodiments include a device, sometimes referred to herein as a cable spool, for storing, organizing and carrying connectivity cables for electronic devices. In at least some embodiments, the inventive device has an opening for receiving and/or retaining a component that extends or connects to a cable. The cable in turn can be retained about a perimeter of the inventive device. In some implementations, the cable may be wound about the perimeter surface to retain the cable in a spooled position. While at least partially in the spooled position, the cable may be extended to mate with another component (e.g. power adapter, computer, phone).

In some embodiments, the inventive device includes an oblong, ovular, or elongated body. The body may include a cavity sized and shaped to retain at least one end of the cable (i.e. a USB head). In an embodiment, the device is monolithic and has no moving parts. In an embodiment, the device protects both terminal ends of a cable device, along with the cable itself. In an embodiment, the devices of the invention are stackable for easy organization. In an embodiment, the device of the invention does not pinch or damage the cables being stored therein. In an embodiment, the curved features and size/shape of the device allows it to be easily stored in a pocketbook, pants pocket, drawer, briefcase, or otherwise, without snagging or catching.

Turning to the drawings, FIG. 1 illustrates the device 100 comprised of a body 10 having a longitudinal dimension Li, a top face 12, a bottom face 14, and at least one side face 16 extending along the longitudinal direction Li. The elongated body may have curved ends 18. In an embodiment, the body 10 may comprise an elongated reel or spool having a barrel 40 and two flanges affixed to opposite ends of the barrel 40. The flanges may comprise an upper flange 42 and a lower flange 44. In an embodiment, the upper flange 42 may be thicker or deeper than the lower flange 44. In an embodiment, the barrel may connect to the upper flange 42 and/or a lower flange 44 in a gradual curved manner. In an embodiment, the upper flange 42 and/or lower flange 44 extend outwardly beyond the barrel 40, such that when a cable is wrapped about the barrel 40, the flanges overlay and protect the cable.

The body 10 may comprise a cavity 20 located in the top face 12 or bottom face 14. In an embodiment, the cavity 20 may be disposed in the center of the top face 12 or bottom face 14. In this embodiment, the cavity may be disposed in a recessed manner from the top face 12, for example, of the body 10. The cavity 20 may comprise a base wall 22 and one or more sidewalls 24. The cavity 20 may be shaped and sized, in an embodiment, to receive a USB cable head (i.e. a first terminal end of the cable). In an embodiment, the USB cable head may be inserted into the cavity 20 and may be slid in a longitudinal direction to lock into place. In some embodiments, the first terminal end of the cable (i.e. USB cable head) fits into the device in a friction fit. In this embodiment, the top face 12 (or bottom face 14) and the cavity sidewall 24 may be disposed in a manner which locks the USB cable head in place. For example, FIG. 1 illustrates an angled portion 30 which allows the USB cable head to fit thereunder and be retained in place unless and until the USB cable head is slid in the opposite longitudinal direction for removal therefrom. In an embodiment, the cavity 20 may be rectangular in nature, comprising the retention features 30 which overhang the rectangular cavity 20. While the invention is described by referring to a USB cable and cable head, it should be understood that any cable, terminal end of a cable, and/or cable head may be utilized in connection with an inventive device having complimentary retention features. For example, in some embodiments, the cavity 20 may be configured to receive ear phones affixed to a cable, the terminal end of an e-cigarette charging cable, manufacturer-specific terminal ends (i.e. Apple® connection devices), or the like.

In an embodiment, a channel 32 connects the cavity 20 to the curved end 18 of the body 10. In an embodiment, the channel 32 is sized and configured to receive the cable portion of the connection device. For example, with reference to a USB cable, the channel 32 is sized and configured to securely retain the cable portion of the USB cable. Thus, the USB cable head can be inserted into the cavity 20 with the terminal end of the cable head opposite the channel 32. The cable can then be inserted into the channel 32 and pulled away from the body 10, which securely locks the cable head into the retention features 30 of the body 10.

In an embodiment, the upper flange 42 and lower flange 44 may be ovular or elongated in nature. In an embodiment, the upper flange 42 and lower flange 44 are connected via a barrel 40. The barrel 40 may also be ovular or elongated in nature. In an embodiment, the channel 32 connects to the barrel 40 such that the cable may be fitted into the channel 32 and then wrapped or wound around the barrel 40 a plurality of times. In an embodiment, the second terminal end of the cable, opposite the first terminal end of the cable may also be secured in place on the device 100. For example, in an embodiment, the second terminal end of the cable may be retained in one or more notches 34 disposed in the upper flange 42 or the lower flange 44. In this embodiment, the cable may be inserted into a notch 34 just before the second terminal end of the cable. The notch may be sized and configured to allow insertion of the cable but may be smaller than the width and/or length of the second terminal end of the cable, such as to retain the second terminal end of the cable in position. In some embodiments, one or more notches 34 may connect to one or more lower cavities 50 disposed on the lower flange 44. In this embodiment, the lower cavities may be shaped and sized to receive the second terminal end of the cable. In an embodiment, the notches 34 may be uniform in shape and width. In other embodiments, one or more notches may comprise a channel entry and a cylindrical endpoint (see FIG. 4).

In an embodiment, the body 10 has indentions 60 in the sidewall 16 of the upper 42 or lower flange 44. In this embodiment, the indentions 60 may be sized and configured to comprise finger holds or gripping features, wherein the device can be grasped while winding the cable. In an embodiment, the indentions 60 are centrally located within the sidewall 16, on opposite longitudinal sides of the device 100.

In an embodiment, the device 100 may comprise magnets, Velcro®, or other fastening devices that allow the device to be temporarily affixed to something else, such as a refrigerator or bulletin board. In an embodiment, the first and/or second terminal end of the cable device may be plugged into an appropriate device while the majority of the cable is wrapped about the barrel 40. In this embodiment, the device is useful in organizing the relevant workspace by effectively shortening the cable length to avoid unnecessary unwound cable.

In an embodiment, the device can be easily and quickly unwound by removing one of the first or second terminal ends of the cable from the relevant retention feature and then holding such end while letting go of the device. Gravity will pull the device downward and allow unwinding of the cable. The device will remain affixed to the terminal end of the cable which was not removed from the device until the user wishes to manually remove the same.

In an embodiment, the device itself contains foldable charging prongs such that the device 100 may plug into a standard outlet. In this embodiment, the device 100 additionally comprises one or more inputs for connection of electrical cables, such as a USB device.

In an embodiment, the device is integrally molded. In an embodiment, the device is 3D printed. In an embodiment, the material used to mold the device is an antimicrobial polymer. In other embodiments, the flanges and/or barrel may comprise a snap-fit configuration so that they may be removable and replaceable. In an embodiment, the device 100 comprises a clip feature such that it may be clipped onto a keychain, strap, belt loop, or the client. In an embodiment, the device may comprise an elongated cavity from one of the curved ends 18, into the top flange 42, to stow a toothpick, set of tweezers, or similar device. In certain embodiments, the devices may be colored or color-coded to specify the type of cable they are designed for. In an embodiment, the device may be removably affixable to a mobile device, like a phone, such that the inventive device can store excess cabling while the phone is charging, for example.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An organizing device for cables comprising a spool, wherein the spool comprises:

a barrel;

an upper flange affixed to a first side of the barrel; and a lower flange affixed to a second side of the barrel, wherein the barrel is elliptical and wherein the upper flange and the lower flange each extend outwardly beyond the barrel, wherein each of the two flanges has an outer face, a first side face, and a second side face, each of the first and second side faces extending between two elongated ends of each of the flanges, wherein the upper flange comprises a cavity, shaped and sized to receive a first terminal end of a cable, located in the outer face of the upper flange, and wherein the cavity comprises a bottom surface, a top surface, and at least one sidewall, and wherein the top surface comprises a retention feature which overhangs to bottom surface and secures the first terminal end of the cable in position.

2. The device according to claim 1 wherein the cavity is rectangular.

3. The device according to claim 2 additionally comprising a channel extending from the cavity to one of the two elongated ends of the upper flange.

4. The device according to claim 3 wherein the channel is configured to receive the cable.

5. The device according to claim 4 wherein when the first terminal end of the cable is inserted into the cavity and the cable is inserted into the channel and pulled away from the cavity, the first terminal end of the cable is securely locked under the retention features.

6. The device according to claim 1 wherein the two elongated ends of each of the flanges are curved.

7. The device according to claim 1 wherein each of the two flanges are elliptical.

8. The device according to claim 1 wherein the barrel is curvedly affixed to the upper flange and to the lower flange.

9. The device according to claim 1 wherein the barrel is configured to receive the cable such that the cable can be wound about the barrel.

10. The device according to claim 1 additionally comprising at least one notch disposed in the first or second side face of the upper flange or the first or second side face of the lower flange.

11. The device according to claim 10 additionally comprising a plurality of the notches.

12. The device according to claim 11 wherein the notches are sized to receive the cable.

13. The device according to claim 11 wherein the notches are smaller in at least one dimension than a second terminal end of the cable.

14. The device according to claim 1 additionally comprising at least one lower cavity disposed within the lower flange.

15. The device according to claim 14 wherein the at least one lower cavity is configured to receive the second terminal end of the cable.

16. The device according to claim 1 additionally comprising at least one curved finger hold in the side wall of the upper flange or lower flange.

17. The device according to claim 16 comprising at least two curved finger holds centrally located within the side wall of the upper flange or lower flange, on opposite longitudinal sides of the device.

* * * * *